US006618859B1

(12) United States Patent
Kadymir et al.

(10) Patent No.: US 6,618,859 B1
(45) Date of Patent: Sep. 16, 2003

(54) PERSPIRATION PAD FOR SLEEVELESS GARMENT

(76) Inventors: Jack Kadymir, 448 Neptune Ave., #16J, Brooklyn, NY (US) 11224; Richard Schweitzer, 3569 W. Atlantic Blvd., #213, Pompano Beach, FL (US) 33069

( * ) Notice: Subject to any disclaimer, the term of this patent is extended or adjusted under 35 U.S.C. 154(b) by 0 days.

(21) Appl. No.: 10/310,442

(22) Filed: Dec. 6, 2002

(51) Int. Cl.[7] ..... A41D 27/13
(52) U.S. Cl. ..... 2/53; 2/56
(58) Field of Search ..... 2/53, 54, 55, 56, 2/57, 58, 455, 267, 268; 604/385.201, 358, 385.03, 385.01, 385.16, 386, 387, 388, 390, 391, 393

(56) References Cited

U.S. PATENT DOCUMENTS

| | | | | | |
|---|---|---|---|---|---|
| 348,390 | A | * | 8/1886 | Frank | 2/53 |
| 722,617 | A | * | 3/1903 | Peet | 24/357 |
| 833,948 | A | * | 10/1906 | Trenckmann | 2/53 |
| 1,081,016 | A | * | 12/1913 | Bush | 2/53 |
| 2,263,838 | A | * | 11/1941 | Ermisch | 2/53 |
| 2,438,771 | A | * | 3/1948 | Topjian | 2/53 |
| 2,497,843 | A | * | 2/1950 | Berle | 2/53 |
| 2,562,508 | A | * | 7/1951 | Rand | 2/53 |
| 2,654,888 | A | * | 10/1953 | Brightman | 2/53 |
| 2,688,751 | A | * | 9/1954 | Kermode | 2/53 |
| 2,911,647 | A | * | 11/1959 | Dixon et al. | 2/53 |
| 3,001,201 | A | * | 9/1961 | Hauser | 2/56 |
| 3,132,346 | A | * | 5/1964 | Clayfield | 2/53 |
| 3,588,916 | A | * | 6/1971 | Glatt | 2/53 |
| 4,485,492 | A | * | 12/1984 | Sneider | 2/56 |
| 4,663,780 | A | * | 5/1987 | Rawlings et al. | 2/53 |
| 4,747,162 | A | * | 5/1988 | Yanagihara | 2/53 |
| 4,856,111 | A | * | 8/1989 | Sholes | 2/56 |
| 5,038,409 | A | * | 8/1991 | Nager et al. | 2/56 |
| 5,042,088 | A | * | 8/1991 | Sherrod et al. | 2/53 |
| 5,103,500 | A | * | 4/1992 | Nager et al. | 2/56 |
| 5,570,471 | A | * | 11/1996 | Krawchuk | 2/53 |
| 5,790,982 | A | * | 8/1998 | Boutboul et al. | 2/53 |
| 5,864,889 | A | * | 2/1999 | Suffern | 2/247 |
| 5,884,330 | A | * | 3/1999 | Erlich | 2/53 |
| 6,138,276 | A | * | 10/2000 | Asciutto et al. | 2/53 |
| 6,269,486 | B1 | * | 8/2001 | Nager et al. | 2/53 |

* cited by examiner

*Primary Examiner*—John J. Calvert
*Assistant Examiner*—Alissa L Hoey
(74) *Attorney, Agent, or Firm*—Myron Amer P.C.

(57) ABSTRACT

An underarm perspiration pad having a length portion of an upper edge connected between opposite selectively sized triangular shapes, wherein the selected size of each triangular shape in the underarm site of use of the perspiration pad is of an extent that it is readily observable above the edge of a sleeveless garment arm opening, and the observed portions of the triangular shapes are trimmed preparatory to removal along lines of perforations so as to minimize cognitive awareness of the use of the perspiration pad.

1 Claim, 2 Drawing Sheets

PERSPIRATION PAD FOR SLEEVELESS GARMENT

The present invention relates generally to improvements in garment underarm disposable perspiration pads, in which more particularly, the improvements are applied to their use in sleeveless garments.

EXAMPLES OF THE PRIOR ART

Pads, also known as shields, of fluid-absorbing construction material are in popular use to minimize staining of the underarm and adjacent areas of garments, as exemplified by those of prior patents No. 1,727,287 for "DRESS SHIELD" issued to Hoffman on Sep. 3, 1929, U.S. Pat. No. 1,912,178 for "SHIELD" issued to Conoyer on May 30, 1933, U.S. Pat. No. 3,001,201 for "GARMENT SHIELD" issued to Hauser on Sep. 26, 1961 and U.S. Pat. No. 4,747,162 for "DISPOSABLE PERSPIRATION ABSORBING PAD" issued to Yanagihara on May 31, 1988, to mention but a few. The popularity in use however particularly by females, is voluntarily curtailed curiously during the time when most needed, namely during the summer months when temperature and activity outdoors promotes perspiration, because it is also at this time that fashion and comfort dictate the use of sleeveless garments, and when the perspiration pad is not hidden beneath a sleeve it is considered by many to be source of unsightliness.

Broadly, it is an object of the present invention to provide a perspiration pad for a sleeveless garment overcoming the foregoing and other shortcomings of the prior art.

More particularly, it is an object to provide a perspiration pad for a sleeveless garment, and taking into account the necessary variation for fashion concerns of the different configurations of the edge bounding the sleeveless garment arm openings, that is readily customized to the sleeveless garment arm opening such that there is no cognitive awareness of its presence in its underarm site of use, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
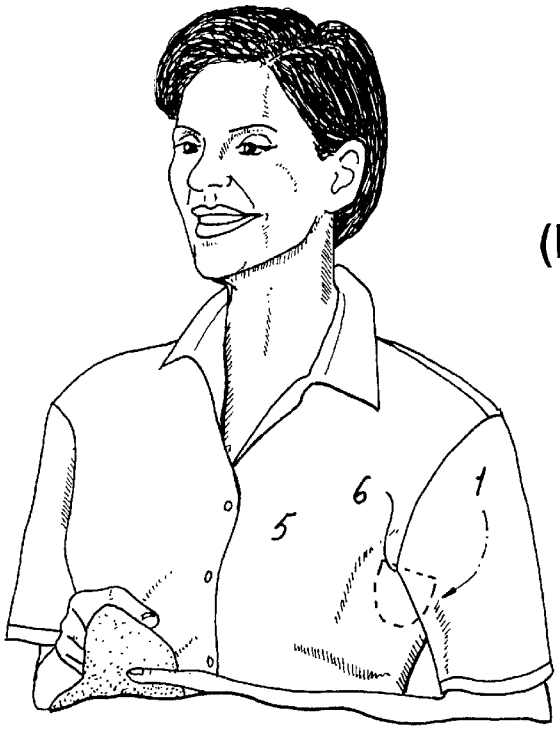
FIG. 1 (Prior Art)
FIG. 1 is a perspective view of a prior art underarm perspiration pad.
Figure 2:
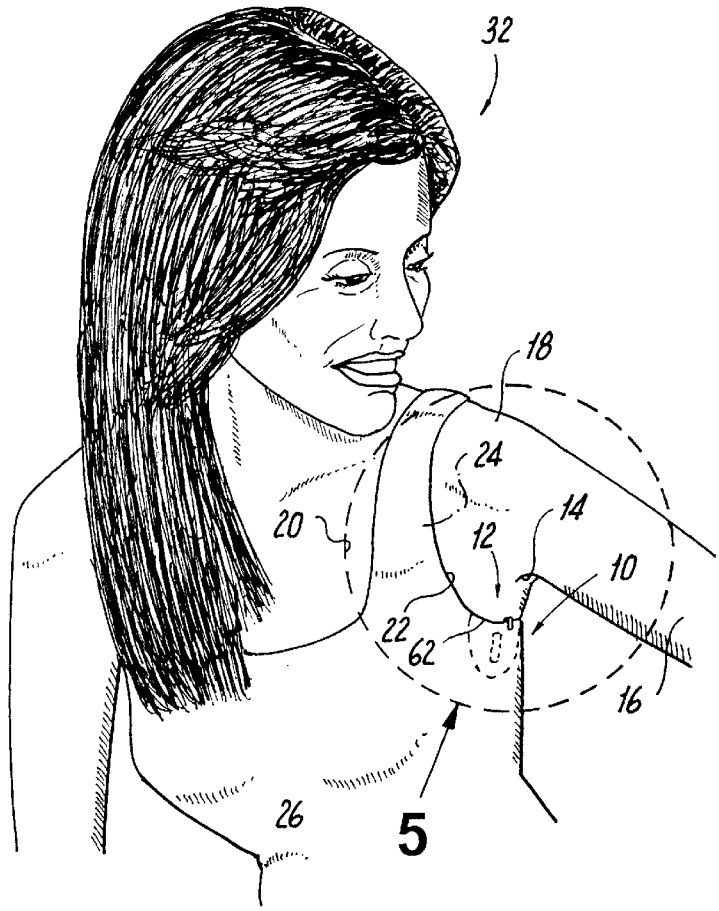
FIG. 2 is a perspective view of a perspiration pad for a sleeveless garment in accordance with the present invention.
Figure 3:
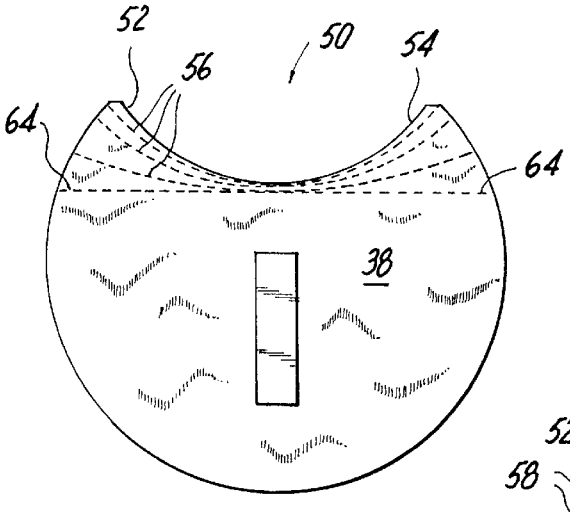
FIG. 3 is an isolated front view of the perspiration pad of FIG. 2.
Figure 4:
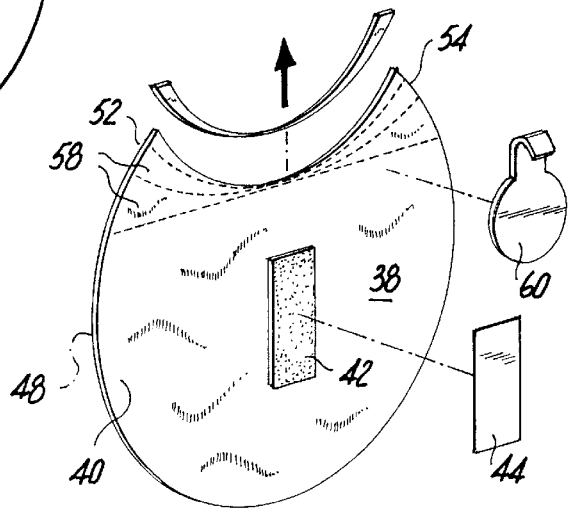
FIG. 4 is an exploded perspiration pad of FIG. 3.

To prevent clothes from being stained with perspiration, prior patents, as exemplified by U.S. Pat. No. 4,747,162 for "DISPOSABLE PERSPIRATION ABSORBING PAD" issued to Yanagihara on May 31, 1988, recommend, as illustrated in FIG. 1, the use of a perspiration pad 1 in an underarm location 6 in the sleeve of a jacket or like upper torso garment 5. Pad 1 adequately serves its intended stain-resisting purpose in the environment noted, but in a sleeveless garment, when the pad 1 would not be hidden beneath a sleeve, there is another need to be served, and that is to obviate unsightliness in the wearing of the pad that results from a mere cognitive awareness of its presence at the underarm location 6. The present invention addresses this need, and relates to a perspiration-absorbing disposable pad means of the nature of the prior art pad 1, which is noteworthy in that it is substantially arranged to be masked from view in its site of use during the wearing of a sleeveless garment.

Figure 5:
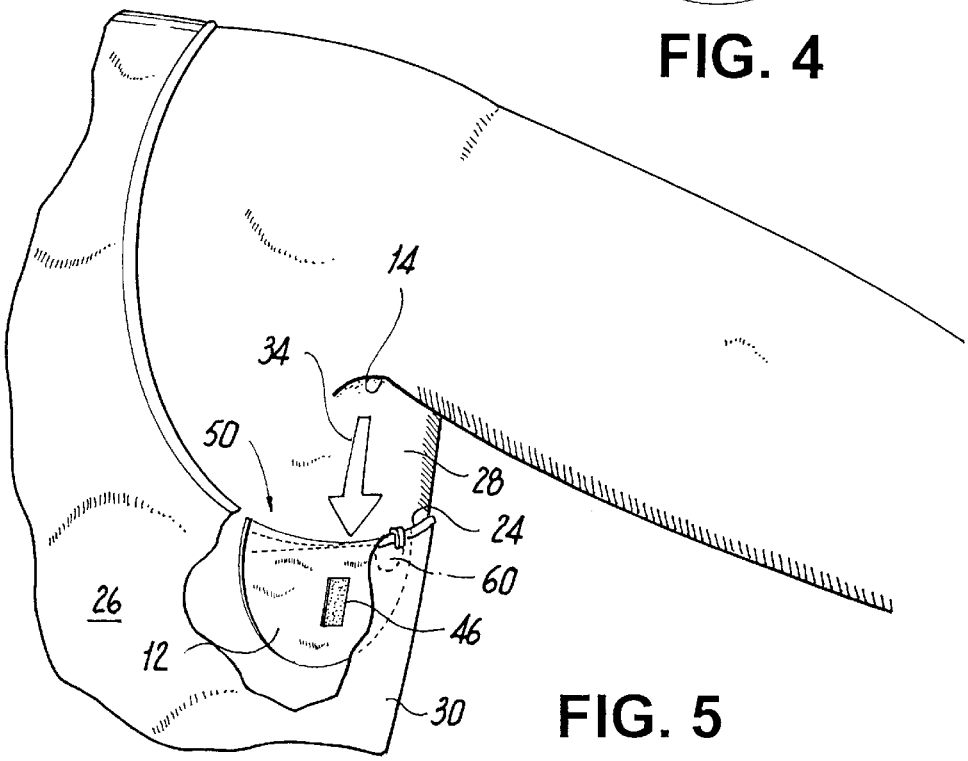
FIG. 5 is a partial perspective view, on an enlarged scale, of the site of use of the perspiration pad denoted by the arrow 5 of FIG. 2.

The within inventive disposable underarm perspiration pad, generally designated 10, has a site of use, generally designed 12, which, as known, is at an underarm 14 of an individual's arm 16 and shoulder 18. More specifically, site 12 is aptly circumscribed by a first circular configuration noted by reference line 20, an edge having a second circular configuration noted by reference line 22, which serves as an arm opening 24 of a sleeveless garment 26, between which reference lines 20 and 22, which are in concentric relation to each other, there is bounded by these concentric reference lines 20, 22 an expanse 28 (FIG. 5) on the side 30 of the individual 32 wearing the pad 10. Bodily movement, temperature conditions, and like factors, typically result in the gravity flow, as noted by the arrow 34, of perspiration from the underarm location 14 over expanse 28 down to the site of use 12 of the perspiration pad 10. In accordance with its known intended use, the pad 10 has stain-resistant utility and, in accordance with the present invention, it has a minimal observed presence above the lower length portion of the sleeveless garment arm-opening 24 and thus provides a correspondingly minimal cognitive awareness of the wearing of the pad which many female users consider a source of unsightliness and thus undesirable.

Constructionwise, pad 10 has a generally semi-circular body 38 and will be understood to be of fluid-absorbent construction material. On an outward facing surface 40 of body 38, there is a deposit of an adhesive 42 covered by a release tape 44 which is removed to expose the adhesive and contribute to its use in establishing an adhesive attachment, as at 46, to the inside of the garment 26, positioning the opposite surface 48 against the side of the individual and, most important, positioning an upper semi-circular edge 50 of the body in the proximity of the lower length portion of the sleeveless garment arm-opening 24.

Since the radial curvatures of arm openings of sleeveless garments differ, and also the anatomical sizes and radial curvatures of underarms of the users of the pad also differ, a correlation of these differences and adjustment for how these differences impact on how the pad 10 presents itself during wearing use, is a significant concern addressed in the construction of the pad 10. What is an underlying designing concept is the making of the curvature of the pad edge 50 so that it intentionally is of a extent which presents opposite triangular shapes 52 and 54 extending above the lower length portion of expected to be encountered curvatures of a lower length portion of a garment arm-opening sleeve edge 24. Marked in these triangular shapes 52, 54 are a series of lines of perforation, individually and collectively designated 56, which are spaced at graduated distances, individually and collectively designated 58, so that one line of perforation 56 will assume a readily observable closely aligned relation with the lower portion of the arm-opening sleeve edge 24.

The portion of the excess of the pad 10 extending into the expanse 28, which if not removed would be a source of unsightliness, is removed in a facilitated manner by the separation afforded by the perforation construction of the line 56 coinciding with the lower length portion of the sleeveless garment arm-opening 24. In this manner, the perspiration pad 10 is custom-sized to the circular configuration of the sleeveless garment arm opening 24 to contribute to a minimal unsightly appearance of the perspiration pad 10 in its site of use 12.

Before disposing of a used perspiration pad 10, the user can advantageously use it in preparing a fresh pad for the next wearing of the same or a closely similarly fashioned garment.

Also, the user can optionally use a thin-gauge metal clip 60 bent in half to supplement the engagement of the center, as at 62, of the pad 10 to the sleeve edge 24. In styles of garments with rearwardly extending straps, the pad would be trimmed along the horizontally oriented perforated line 64.

While the custom-sizing of a sleeveless garment perspiration pad herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A disposable underarm perspiration pad having a site of use in an exposed armpit of a female user wearing a sleeveless garment, said perspiration pad comprising a generally semi-circular body of fluid-absorbent construction material having opposite outward and inward surfaces and an upper edge of a semi-circular configuration located beneath an edge bounding a lower length portion of an arm opening of said sleeveless garment an adhesive deposit on said perspiration pad body outward surface, said perspiration pad body outward surface having an operative position adhesively secured to a sleeveless garment with said upper edge thereof in adjacent relation behind and in alignment with said edge of said sleeveless garment arm opening, said upper edge of said perspiration pad body having on opposite sides thereof triangular shapes extending above said lower length portion of said arm opening of said sleeveless garment plural spaced apart lines of perforations in said triangular shapes, and portions of said triangular shapes removed along lines of perforations coinciding with said lower length portion of said arm opening of said sleeveless garment whereby any exposed portions of said triangular shapes above said lower length portion of said sleeveless garment arm opening are trimmed along a line of perforations to contribute to a minimal unsightly appearance of said perspiration pad in its site of use.

* * * * *